United States Patent [19]

Klaeger

[11] Patent Number: 4,751,969

[45] Date of Patent: Jun. 21, 1988

[54] APPARATUS AND METHOD FOR REMOVING FLUIDS FROM A WELL

[76] Inventor: Joseph H. Klaeger, P.O. Box 446, Hondo, Tex. 78861

[21] Appl. No.: 798,000

[22] Filed: Nov. 14, 1985

[51] Int. Cl.[4] ..... E21B 19/08; E21B 37/10; E21B 43/00

[52] U.S. Cl. ..... 166/369; 166/53; 166/68; 166/72; 166/105; 254/270; 254/379

[58] Field of Search ..... 166/369, 76, 79, 80, 166/85, 91, 92, 93, 170, 176, 177, 53, 72, 77.5, 385, 68.5, 104, 105, 106, 75.1, 153–156, 202; 254/379, 378, 323, 270, 269

[56] References Cited

U.S. PATENT DOCUMENTS

| | | | |
|---|---|---|---|
| 1,997,727 | 4/1935 | Greve | 188/77 |
| 2,633,808 | 4/1953 | Webber | 103/225 |
| 2,985,432 | 5/1961 | McCray | 257/191 |
| 3,774,685 | 11/1973 | Rhodes | 166/314 |
| 3,989,106 | 11/1976 | Taylor | 166/176 |
| 4,585,061 | 4/1986 | Lyons, Jr. et al. | 166/85 X |

*Primary Examiner*—Stephen J. Novosad
*Attorney, Agent, or Firm*—Cox & Smith Inc.

[57] ABSTRACT

Apparatus and method for removing fluid from a well. The apparatus is mobile, and includes a power winch mounted on a mobile support means with a cable attached to the winch. A constant tension maintaining unit is connected to the winch to maintain relatively constant tension on the cable while the cable is wound off the power winch into the well, and a swab is mounted on the free end of the cable. The swab is operable to lift the fluid out of the well when the cable is wound back onto the power winch. Also included is a means in fluid connection with the well operable to receive the fluid lifted out of the well by the swab. Also provided is a swab bar for use in removing fluid from a well and a device for effecting a seal with the well head.

23 Claims, 5 Drawing Sheets

APPARATUS AND METHOD FOR REMOVING FLUIDS FROM A WELL

BACKGROUND OF THE INVENTION

The present invention relates to an apparatus and method for removing fluids from a well. More particularly, the present invention relates to a mobile apparatus capable of lifting fluids, particularly oil, out of a well using a swab mounted on the free end of a cable which is run down the well and then retrieved, bringing the fluid up with it, and collecting and storing the fluid as it is removed from the well.

The present invention relates particularly to the production of oil from shallow oil wells, on the order of approximately 1,000 to 1,500 feet deep. These wells are typically located in soft formations, such as sand, which make them difficult to produce. When used on such wells, conventional production methods such as pumping, chamber lifts or jetting have several disadvantages. For instance, because of the high sand content of the oil in those wells, the pumps which are used are subject to clogging. Further, because of the low production of such wells, it is not economical to jet high-pressure air into the well to force the oil up out of the well because an electric motor is required to operate an air compressor, and large amounts of energy are consumed to produce a relatively small amount of oil from the well.

Many different devices and methods have been tried for the production of oil from these stripper wells (wells which produce less than about 10 barrels of oil a day). However, so far as is known, all the equipment and methods developed must be removed from the well from time to time so that the well may be sand pumped or swabbed to clean the well bore and perforations. Sand pumping and swabbing with conventional rental units is a relatively expensive procedure, and is prohibitively expensive on many stripper wells due to their low production. Although swabbing the wells is one of the best and most reliable methods, it is also the most expensive, requiring a two or three man crew and perhaps as much as half a day, depending upon the depth of the well, to perform.

There is, therefore, a need for a method and apparatus capable of producing oil from those wells economically. There is also a need for an apparatus and method capable of producing oil from those types of wells in an economical and reliable fashion.

SUMMARY OF THE INVENTION

The present invention provides an apparatus capable of cleaning and producing shallow wells in economical fashion comprising a mobile support means, a power winch mounted on the mobile support means and having a cable attached thereto, and means operably connected to the power winch to maintain a relatively constant tension on the cable while the cable is being wound off of the power winch into the oil well. A swab is mounted on the free end of the cable and is operable to lift oil out of the oil well when the cable is wound back onto the power winch. Also provided is a means in fluid connection with the oil well which is operable to receive the oil lifted out of the well by the swab.

An object of the present invention is to provide an economical and reliable apparatus and method for cleaning the well while simultaneously producing fluid from the well.

Another object of the present invention is to provide a mobile apparatus for producing fluids from a shallow well.

Another object of the present invention is to provide a method and apparatus capable of being operated by a single operator and which can be moved from one well to another, collecting fluid from each well and temporarily storing it until it is convenient to deposit the fluid in a more permanent location or until the storage tank on the apparatus is full.

Another object of the present invention is to provide a device for maintaining relatively constant tension on a cable when that cable is being used to lower a swab into a well.

Another object of the present invention is to provide a swab which can be used to remove fluid from a well.

Still another object of the present invention is to provide a swab which, if it becomes lodged or stuck in the well, can be freed without damaging or ruining the well.

Another object of the present invention is to provide a power winch to lower a swab into a well which is automatically braked to a stop in the event of a power failure or loss of hydraulic fluid.

Another object of the present invention is to provide an apparatus capable of effecting a relatively tight seal with a well to help insure efficient production of the fluid in the well.

Another object of the present invention is to provide an apparatus which, when the seal is broken, will prevent the flow of fluid back into the well.

Another object of the present invention is to provide an apparatus which will not be damaged, and which will not damage the well, when the seal with the well is broken and the apparatus is removed therefrom.

Another object of the present invention is to provide an apparatus in which the hydraulic fluid used to transmit power is cooled by the fluid produced from the well.

Other objects of the present invention will be apparent to those skilled in the art who have the benefit of this disclosure from the following detailed description of the invention.

DETAILED DESCRIPTION OF THE INVENTION

Figure 1:
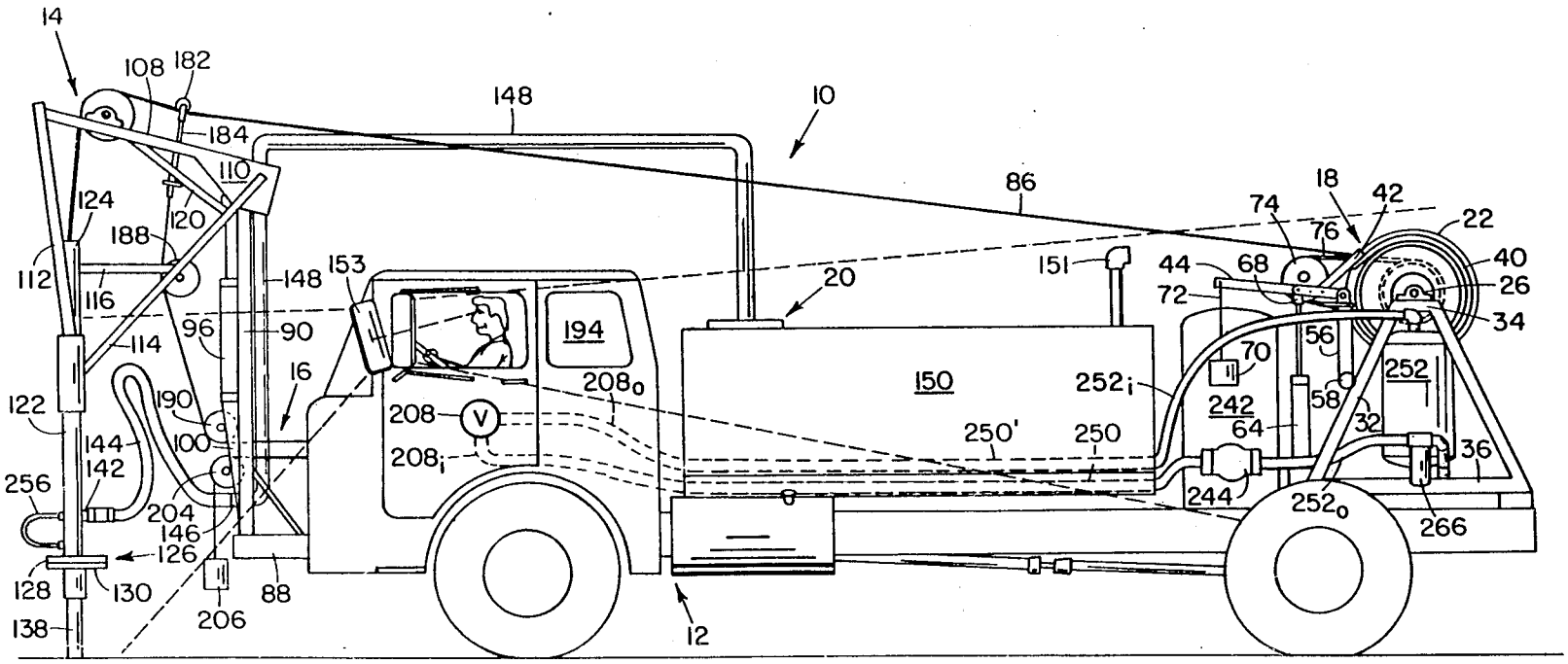
FIG. 1 is a side view of a presently preferred embodiment of the present invention mounted on a truck.

Referring to FIG. 1, there is shown a presently preferred embodiment of the invention, indicated generally by the reference numeral 10. One of the main advantages of the present invention is that it is mobile, and may be mounted on a mobile support means such as a truck 12. The apparatus of the present invention consists of several parts mounted on the truck 12, including the standpipe and boom assembly 14, the constant tension maintaining unit 16, the power winch, indicated generally at reference numeral 18, and the oil receiving unit, indicated generally at 20.

Figure 2A:
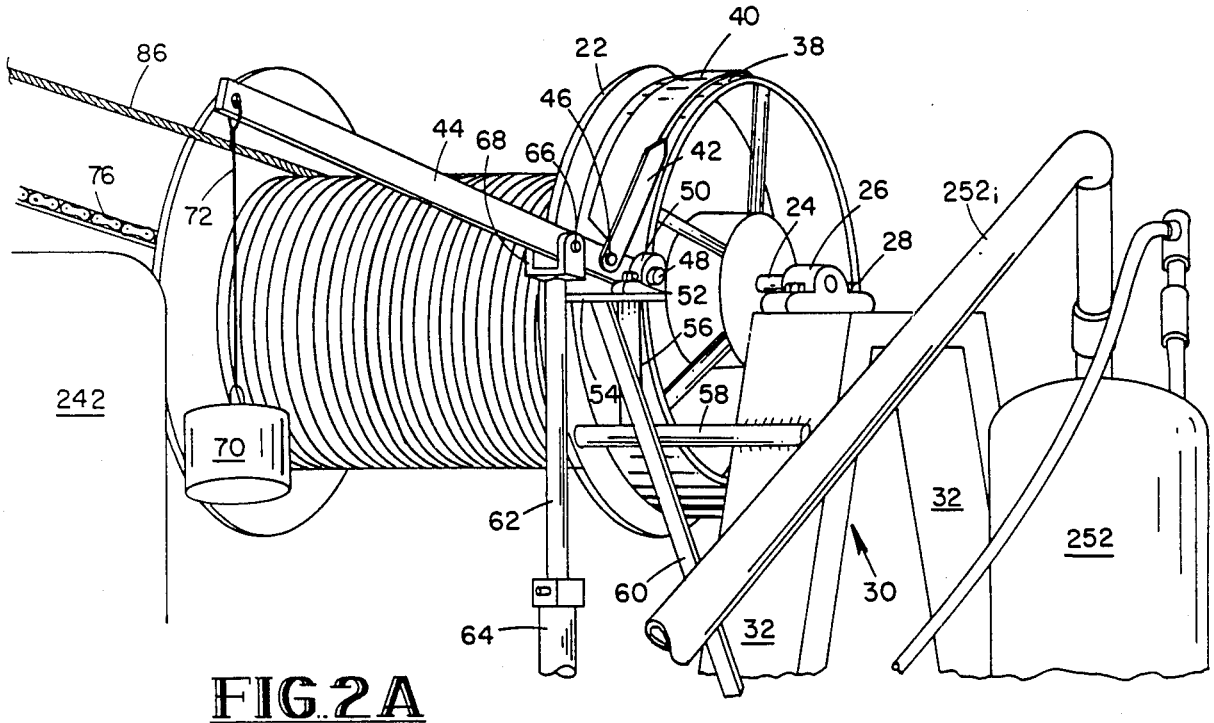
FIG. 2*a is* an enlarged, perspective view of the power winch of the embodiment shown in FIG. 1.
Figure 2B:
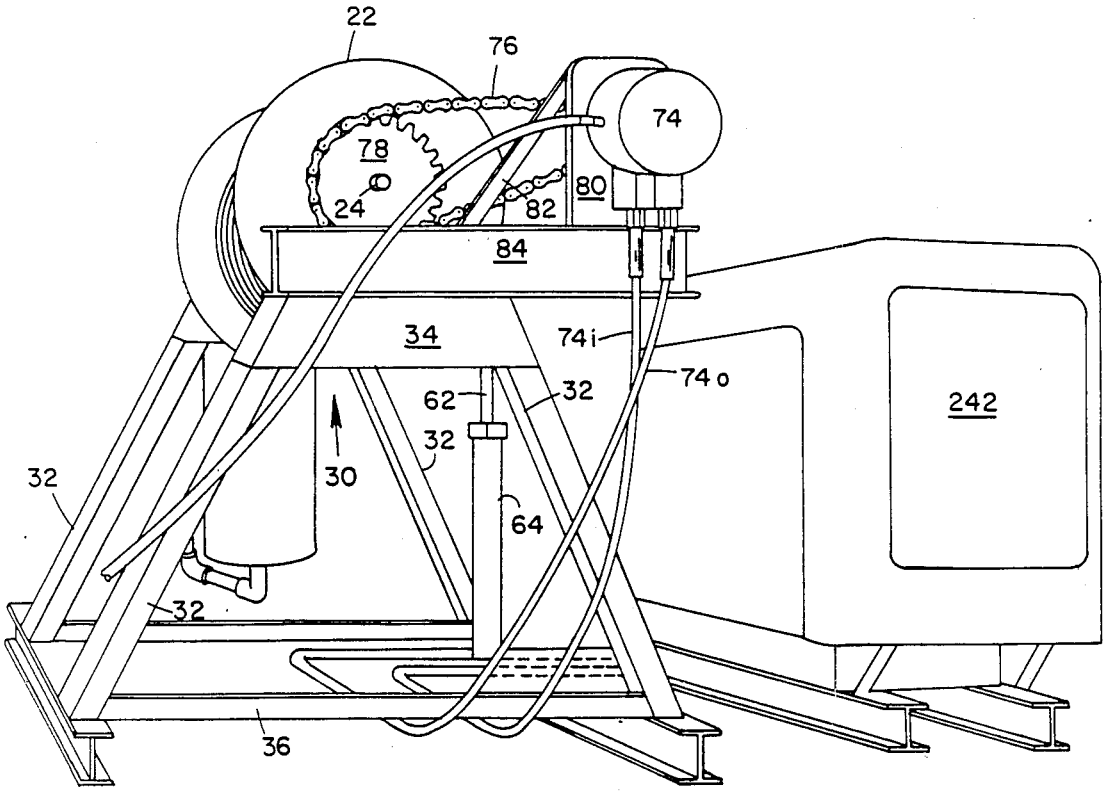
FIG. 2*b* is an enlarged, perspective view of the other side of the power winch shown in FIG. 2*a,* showing the hydraulic motor and hydraulic fluid reservoir of the embodiment of FIG. 1.

Referring to FIGS. 2*a* and 2*b*, the power which 18 is comprised of a reel 22 mounted on axle 24 which is journaled in ears 26. The ears 26 are attached to frame 30 by bolts 28. The frame 30 is comprised of uprights 32, cross members 34 and braces 36.

Reel 22 is provided with brake drum 38 and a brake band 40 encircling the brake drum 38. Tension rod 42 is attached to brake band 40 by welding at one end and to lever 44 on pivot 46 at the other end. Lever 44 is mounted on axle 48 which is journaled in lugs 50. The lugs 50 are attached by bolts 52 to platform 54. Platform 54 is mounted to the upright 32 of frame 30 by means of support member 56, which is welded to the bar 58, which is, in turn, welded to upright 32, and by the brace 60, which is also welded to the upright 32. Lever 44 is pivotally mounted to the extension member 62 of hydraulic cylinder 64 on pin 66 which is journaled on both sides of the U-shaped member 68. Lever 44 is also provided with a weight 70 hung on the end of a cable 72.

The reel 22 of power winch 18 is powered by hydraulic motor 74, which drives the chain 76 and sprocket 78. The sprocket 78 is mounted on the same axle 24 as, and is integral with, the reel 22. Hydraulic motor 74 is mounted to plate 80, which is mounted to cross member 34 of frame 30 by means of brace 82 and I-beam 84. Cable 86 is attached at one end to the reel 22 and is wound thereon.

Figure 3:
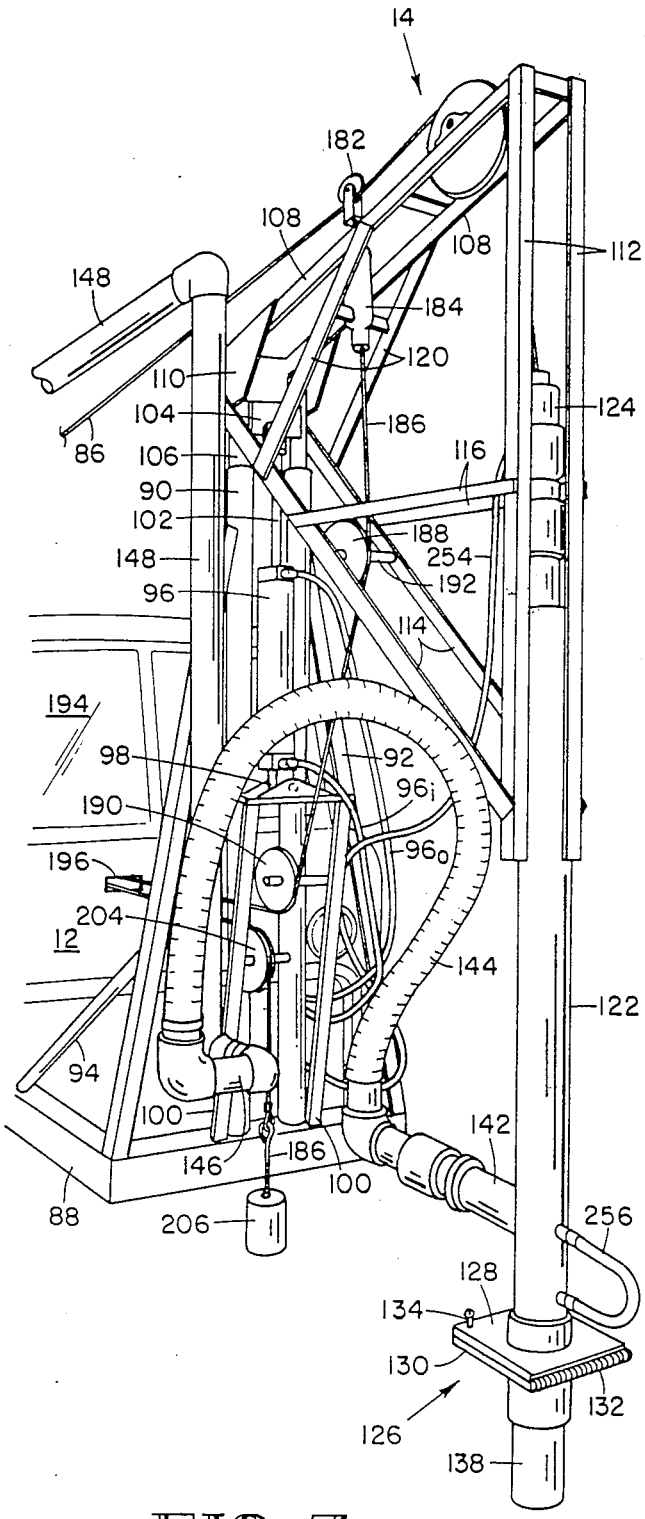
FIG. 3 is an enlarged, perspective view of the standpipe and boom assembly of the embodiment shown in FIG. 1.

Referring to FIG. 3, the standpipe and boom assembly 14 is supported on the front of truck 12 by means of frame 88, to which columns 90 are welded. Additional support for columns 90 is provided by the braces 92 and 94. Hydraulic cylinder 96 is mounted on collar 98, which is supported by the uprights 100 which are welded to the frame 88. The ram 102 of hydraulic cylinder 96 is pivotally mounted to yoke 104 which is integral with the extension members 106 which telescope up out of the columns 90. Boom members 108 are integral with the extension members 106, and are braced by triangle braces 110. Standpipe retention members 112 are welded to the ends of boom members 108, and braced by slats 114 and braces 116. Additional reinforcement for the standpipe and boom assembly 14 is provided by angle braces 120. The standpipe housing 122 is integral with the standpipe retention members 112, and oil saver 124 is mounted to the top of housing 122. Cable 86 enters housing 122 through the oil saver 124, the function of which will be described below.

Figure 3A:
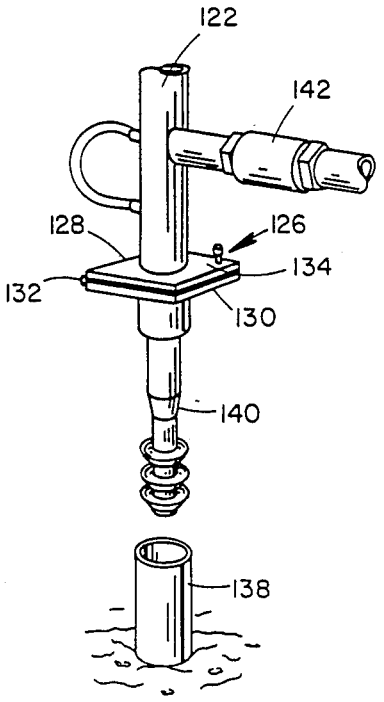
FIG. 3*a* is an enlarged, perspective view of the standpipe assembly shown in FIG. 3, with the boom raised to show the swab mounted on the bottom thereof.
Figure 3B:
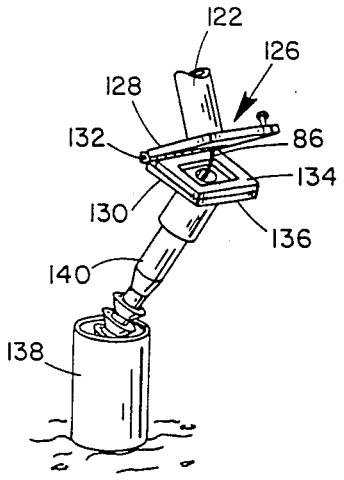
FIG. 3*b* is a perspective view of the bottom of the standpipe assembly and swab as it would appear if the swab were hung up on the side of the well head when the apparatus of the present invention is moved away from the well.

The bottom of the housing 122 is provided with a back-up plate assembly 126, comprised of an upper plate 128 and a lower plate 130, hinged together by hinges 132 and held in closely approximated position by a frangible sheer pin 134. Lower plate 130 is provided with a back-up plate seal 136 made of neoprene, neofab or other resilient material, which seals against the top of wellhead 138 (see FIG. 3*b*) when standpipe housing 122 is lowered by action of hydraulic cylinder 96. Cable 86 extends down through standpipe housing 122 and swab 140 is suspended from the end of the cable 86 (see FIG. 3*a*). Check valve 142 is in fluid connection with the interior of the hollow housing 122, and is connected to hose 144, which is connected to funnel 146. Check valve 142 is a one-way valve which prevents fluid from flowing back out of hose 144 and tank 150. Funnel 146 is in fluid communication with the overhead pipe 148, which connects to the storage tank 150. Vent 151 is provided in storage tank 150 to facilitate the filling and emptying of storage tank 150. Fittings and hoses (not shown) are provided as is known in the art by which the fluid collected in storage tank 150 may be transferred out of the tank 150 into another, stationary storage tank (not shown). A pump (not shown) driven by hydraulic fluid, by power take-off from truck 12 or directly off of motor 242 may be provided to facilitate the unloading of fluid from storage tank 150.

Figure 4:
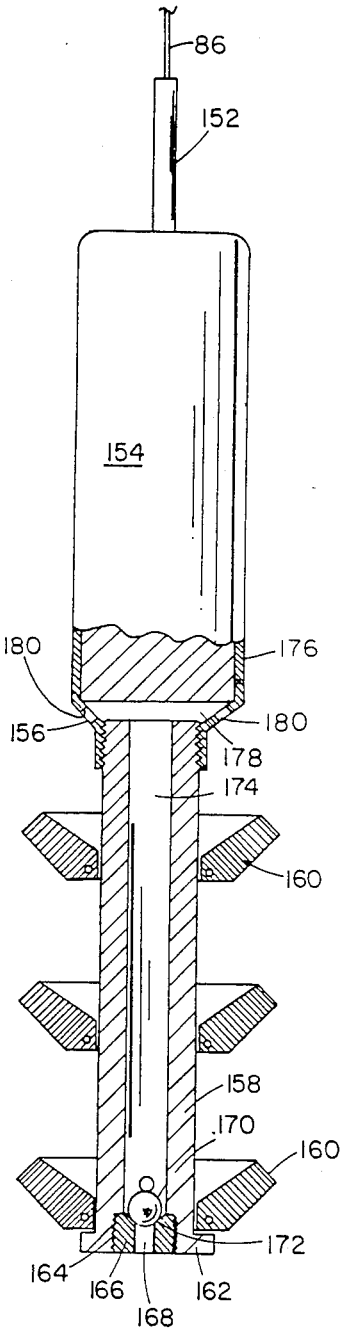
FIG. 4 is a longitudinal section through the swab shown in FIGS. 3*a* and 3*b*.

Referring to FIG. 4, swab 140 is shown in more detail. Cable 86 is attached to swab 140 by means of rope socket 152, which is integral with the casing 176 of swab bar 154. A collar 156 formed in the lower end of the casing of swab bar 154 is threaded to receive mandrel 158. Casing 176 is filled with lead to provide the weight needed to cause swab 140 to move downwardly through the fluid in the well as will be explained. Swab cups 160 are placed on mandrel 158, and retained thereon by the flange 162. Three swab cups 160 are shown, spaced along the length of mandrel 158 for purposes of clarity, but as few as one and as many as will fit on the length of mandrel 156 may be used, depending on the amount of fluid to be removed from the well as will be described. The bottom of mandrel 158 is provided with threads 164 to receive a threaded insert 166 having an orifice 168 therein. The orifice 168 is sealed by a check valve comprising a ball 170 and valve seat 172. Lumen 174 of mandrel 158 communicates with the space 178 in collar 156, which is provided with discharge ports 180 for passage of fluid therethrough.

Figure 4A:
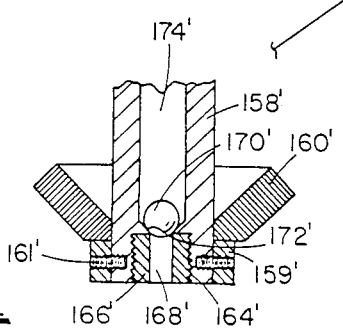
FIG. 4*a* is a longitudinal section through a portion of an alternative construction of a swab which may be constructed in accordance with the present invention.

An alternative construction of swab 140 is shown in FIG. 4*a*, in which corresponding parts are given the same numbers as in FIG. 4. Mandrel 158′ is threaded onto swab bar 154′ and swab cup 160′ is mounted on mandrel 158′ in the same manner as shown in FIG. 4. However, swab cup(s) 160′ is retained on mandrel 158′ by shear sleeve 159′, which is a cylindrical ring retained on the end of mandrel 158′ by frangible shear pins 161. The operation of shear sleeve 159 and shear pins 161 is discussed below.

Figure 5A:
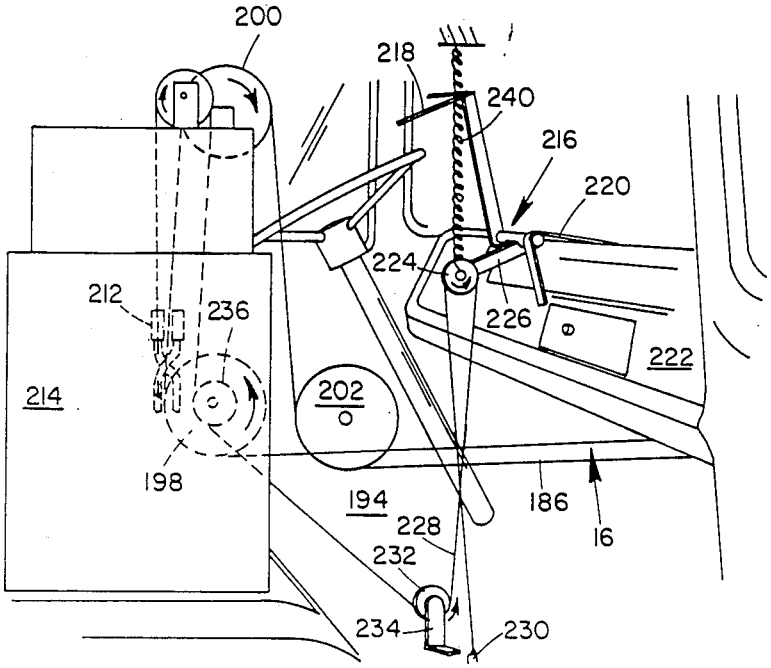
FIG. 5*a* is a schematic view of the constant tension maintaining unit mounted within the cab of the truck shown in FIG. 1.
Figure 5B:
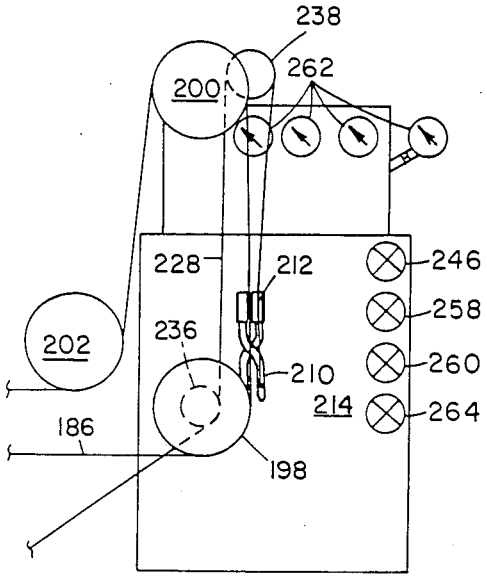
FIG. 5*b* is a view of the constant tension maintaining unit of FIG. 5*a* from the opposite side shown in FIG. 5*a*.

Referring now to FIGS. 3, 5*a*, 5*b*, and 7, the constant tension maintaining unit 16 is shown in more detail. Constant tension maintaining unit 16 is comprised of a pulley 182 which rides on cable 86 and is journaled in reciprocating rod 184. Control cable 186 is secured to the bottom of reciprocating rod 184, and travels downwardly over pulleys 188 and 190, which are mounted on axles 192 which are welded to slats 114 and uprights 100, respectively, of the standpipe and boom assembly 14. Control cable 186 then enters the cab 194 of truck 12 through opening 196 (see FIG. 3). Once inside the cab 194, control cable 186 passes under pulley 198 and upwardly around pulley 200, back down and around pulley 202, back out of the opening 196, over the pulley 204, and is attached to the weight 206. The mounting brackets upon which the pulleys 198, 200, 202 and 238 (see FIG. 5*b*) in the schematic diagrams are mounted are not shown for purposes of clarity. Pulley 204 is mounted to uprights 100. As shown in FIGS. 5*a* and 5*b*, as control cable 186 travels between pulleys 198 and 200, it passes in close proximity to spool valve 208. The spool valve 208 has a handle in the form of a pair of vise-grip pliers 210, the jaws of which are provided with rubber blocks 212 which can be releasably clamped onto control cable 186 between pulleys 198 and 200. Spool valve 208 is a sandwich valve which is a part of the hydraulic compression control unit 214.

Also located within the interior of the cab 194 of truck 12 is a remote control valve unit, indicated generally at reference numeral 216. Lever 218 is attached, by way of bracket 220, to the dashboard 222 of the cab 194. Pulley 224 is journaled on the end of strap 226, which is integral with lever 218 and will pivot with lever 218 on bracket 220. A remote control cable 228 is anchored at one end to the floor of the cab 194 by eyelet 230, passes up and over the pulley 224, back down towards the floor and under pulley 232, which is journaled in L bracket 234 also attached to floor of cab 194. Remote control cable 228 passes upwardly towards the hydraulic compression control unit 214, and over pulley 236 which is mounted concentrically with pulley 198. Remote control cable 228 then continues upwardly over pulley 238 and back down to the spool valve 208, where it is anchored on the vise-grip pliers 210. The remote control cable 228 is kept constantly under tension by means of the spring 240 which is suspended from the top of the truck cab 194 and attaches to the end of strap 226.

Figure 6:
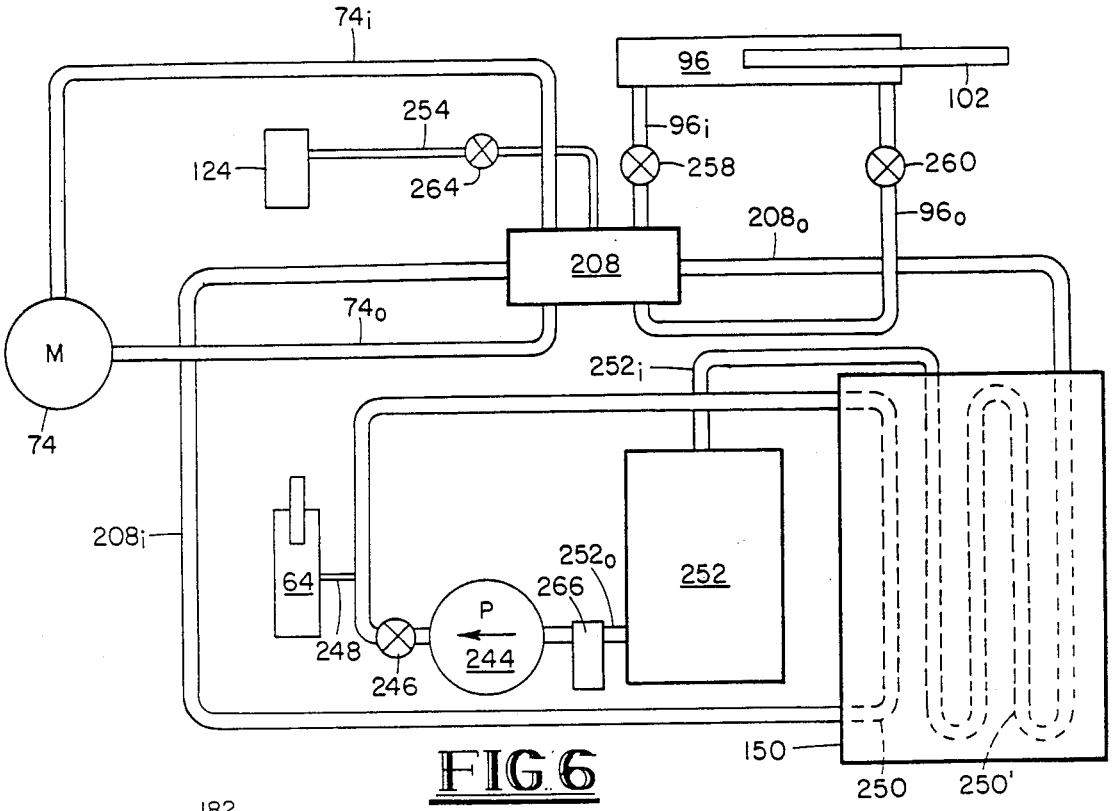
FIG. 6 is a schematic hydraulic diagram of the apparatus of FIG. 1.
Figure 7:
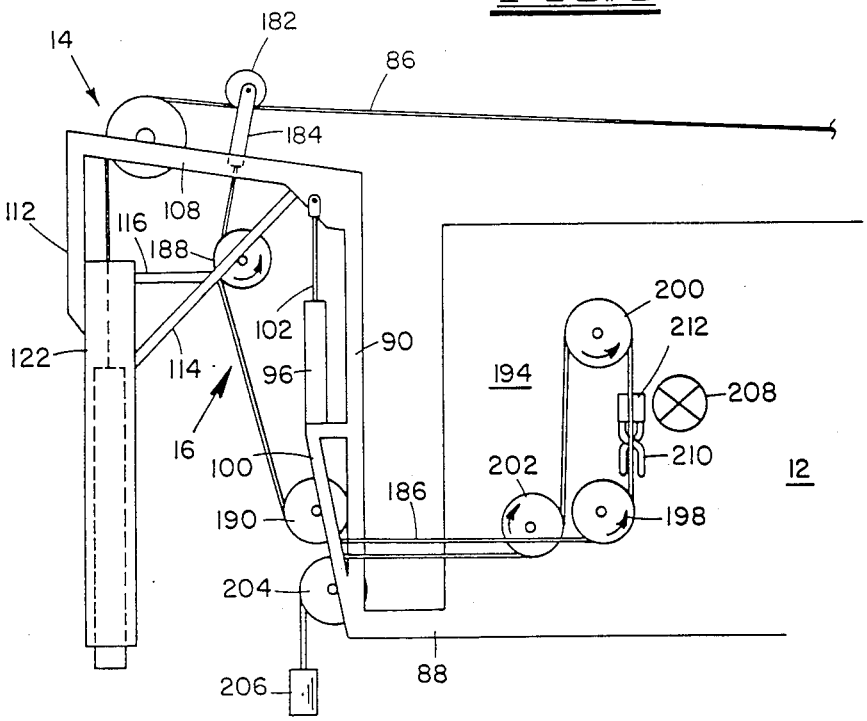
FIG. 7 is a schematic, side view of the constant tension unit of the embodiment shown in FIG. 1.

Referring to FIGS. 1 and 6, the hydraulic system of the presently preferred embodiment of the invention will be described. The hydraulic system is powered by a motor 242 mounted to the truck 12 (see FIG. 1). Motor 242 powers the hydraulic pump 244. A master shutoff valve 246 is provided to bypass the system, thereby shutting down all hydraulic pressure to the system. The hydraulic fluid is pumped through storage tank 150 in input line $208_i$ through loop 250' to the spool valve 208. Cylinder line 248 branches off of input line $208_i$ to power the hydraulic cylinder 64 in the upward direction only. Hydraulic fluid passes out of the spool valve 208 into the input lines $74_i$, to the hydraulic motor 74, and returns to spool valve $208_i$ through the output line $74_o$. Hydraulic fluid is also routed from the spool valve 208 to the raising cylinder 96 through input line $96_i$ and returns through output line $96_o$. Operator-controlled valves 258 and 260 are provided in lines $96_i$ and $96_o$, respectively for raising and lowering ram 102. Valves 258 and 260 are shown schematically on control unit 214 in FIG. 5*b*, as are hydraulic pressures gauges 262, a gauge 262 being supplied for each of the different circuits shown in FIG. 6. The circuit is completed by output line $208_o$, which passes the hydraulic fluid through several loops 250' located in the storage tank 150 and then into the hydraulic oil reservoir input line $252_i$, to the hydraulic oil reservoir 252, and on out of the hydraulic oil reservoir 252 to the pump 244 through output line $252_o$ and water trap 266. Oil saver line 254 runs from input line $96_i$ to the oil saver 124, powering the oil saver 124 in one direction only under control of valve 264.

Operation of the apparatus of the present invention is as follows. The operator drives the truck 12 to the well head 138, and engages valve 264 on the hydraulic compression unit 214 to lower the standpipe and boom assembly 14 down over the well head 138 until the seal 136 engages and seals the top of the well head 138. The operator then pushes the vise-grip pliers 210 which form the handle of spool valve 208 downwardly and closes the vise-grips to grasp the remote control cable 228. In the downward position, the spool valve 208 causes power to be applied to the power winch 18, resulting in the winding of the cable 86 off of the reel 22, thereby lowering the swab 140 down into the well. The cable 86 may be provided with markers or flags (not shown) at 100 foot intervals or with a cable line counter to determine the depth to which swab 140 is lowered. When the swab 140 hits the fluid in the well, there will be a momentary slack in the tension on cable 86 as the buoyancy of swab 140 and the limited amount of fluid which can pass through orifice 168 as described below causes the swab 140 to float in the fluid. This slack in cable 86 will result in the downward movement of the control cable 186 in the vicinity of pulley 182 due to the weight 206 at the end of the control cable 186. The movement caused by the weight 206 will be transmitted to the control cable 186 in the upward direction between pulleys 198 and 200, causing the spool valve 208, by virtue of the blocks 212 which are clamped around control cable 186, to be moved upwardly into the neutral position. When in the neutral position, the flow of hydraulic fluid to the hydraulic motor 74 and the brake cylinder 64 is shut off, causing the brake band 40 to be applied to the brake drum 38 by virtue of the downward force applied to the lever arm 44 by weight 70, resulting in the stopping of the reel 22 so that no more cable is wound off of the reel 22. A mirror 153 is provided so that the operator can monitor the various operations of the apparatus of the present invention from inside the cab 194 of truck 12.

Swab 140 is provided with the swab bar 154, which is comprised of a casing 176 filled with lead or other material of sufficiently heavy weight (i.e., over 140 pounds) to continue to cause the swab 140 to drift downwardly through the fluid in the well. In a presently preferred embodiment, a swab bar 154 of approximately 145 pounds is being used. The continued downward movement of the swab 140 through the fluid in the well will cause the slack in cable 86 in the vicinity of pulley 182 to be taken up such that the spool valve 208 will be opened partially by being pulled downwardly by control cable 186 as the slack is removed from cable 86. This downward pull will cause the speed at which cable 86 unwinds from the reel 22 to be adjusted to correspond to the speed of the downward movement of the swab 140 through the fluid in the well by applying and releasing the brake band 40 to drum 38 and powering hydraulic motor 74. This construction, in addition to adjusting the rate at which cable 86 is wound off of reel 22 to correspond to the rate at which swab 140 sinks down through the fluid in the well, has the advantage of stopping the power winch 18 if damage occurs (i.e., a broken chain drive or loss of hydraulic pressure) because of the slack which will be caused in cable 86 by the damage.

By monitoring the length of cable 186 which is reeled off of reel 22, the operator can determine that swab 140 has sunk down through a sufficient amount of fluid. When swab 140 reaches that desired depth, the operator pushes the lever 218 forward, causing the spool valve 208 to be moved to the upward position, resulting in the reversal of the direction of rotation of the reel 22 so that the cable 86 will be wound back onto the reel 22, retracting the swab 140 from the well.

The swab cups 160 on mandrel 158 of swab 140 will each support approximately 100 feet of oil in a well of 4½ to 5½ inches in diameter. Consequently, if three of the cups 160 are placed on mandrel 158, a column of approximately 300 feet of oil can be lifted from the well. Wells of larger diameter require swabs of larger diameter. Once the direction of reel 22 has been reversed, the swab cups 160 will catch and hold the oil, lifting it up out of the well, where it will be funneled into the standpipe housing 122, through check valve 142 and hose 144, into funnel 146 and up over the cab 194 of truck 12 through the overhead pipe 148 and into the storage tank 150. Fluid receiving unit 20 routes the fluid removed from the well overhead through pipe 148 to reduce the back pressure against the fluid as it comes out of the well.

To keep the oil from being lifted up out of the well and out of the top of the standpipe housing 122, the operator engages the oil saver 124, which has a rubber doughnut therein. When hydraulic pressure is applied to that doughnut, it is forced against the cable 86 so that as oil is drawn upwardly, it cannot escape out the opening through which cable 86 passes. Once the swab 140 has been retrieved all the way up to the top of the well and into the standpipe housing 122, there will still be a column of oil in the standpipe housing 122 above swab 140. To avoid spilling this column of oil, the standpipe housing is provided with a short loop of hose 256 which is placed such that one end is above the swab 140 when the swab is retracted all the way into standpipe housing 122, and one end is below the swab 140 so that the oil in the column above swab 140 when retracted will drain back down into the well. If the well contains more than, for instance, the 300 feet of oil, the operator can then reverse the direction of rotation of the reel 22 and reenter the well to retrieve the additional oil.

Swab 140 is provided with a threaded insert 166 having an orifice 168 therein (see FIGS. 4 and 4*a*). Depending upon the type of fluid to be raised out of the well with the present apparatus, and the viscosity of that fluid, this threaded insert 166 may be replaced with an insert with an orifice 168 of different size. The ability to switch threaded inserts 166, thereby changing the size of the orifice 168, is particularly important due to the high viscosity of the oil which is often found in stripper wells. Even though some oil will pass between the edges of swab cup(s) 160 and the walls of the well as swab 140 sinks, most of the oil passes through orifice 168, consequently the size of orifice 168 will have considerable effect on the rate at which swab 140 sinks, which, in turn, affects constant tension maintaining unit 16, which controls spool valve 208. The size of orifice 168 is also important because, if it is too large, swab 140 will not float momentarily on the oil when lowered into the well so that the operator will not be able to tell how deep into the fluid swab 140 has been lowered. As swab 140 sinks through the oil in the well, the oil passes through the orifice 168, past the ball 170, and up into the lumen 174 in the mandrel 158 of swab bar 140. The oil passes next into the space 178 and out the discharge ports 180 of collar 156 as the swab 140 sinks down through the fluid in the well. When power winch 18 is reversed to retract swab 140 from the well, ball 170, which is constructed of rubber covered nylon or similar resilient material, will be seated in valve 172 by the back pressure of the fluid which has passed through orifice 168, thereby preventing flow back through orifice 168. Both the swab 140 shown in FIGS. 4 and 4*a* operate similarly in this regard.

The mandrel 158 shown in FIG. 4 is preferably constructed of aluminum so that, should swab 140 become stuck in the well, a concentrated mineral acid such as hydrochloric acid can be poured down into the well so that it will move downwardly through the oil until it reaches mandrel 158, where it will dissolve the aluminum such that swab cups 160 will be left in the well and swab bar 154 will be freed from the well. In this manner, the well will not be ruined should the swab 140 be hung up downhole. Alternatively, the mandrel 158' (see FIG. 4*a)* may be provided with the shear sleeve 159' and shear pins 161'. Should swab 140' be hung up or lodged in the well, an additional upward force is applied by way of cable 86, shearing the frangible shear pins 161', allowing the swab bar (not shown in FIG. 4*a*), and everything mounted on it except the shear sleeve 159', swab cup(s) 160' and broken shear pins 161' to be removed from the well.

Once the operator has retrieved all the available fluid from the well, the standpipe and boom assembly 14 is raised up off the well head 138 and the operator can proceed to the next well to repeat the process until the storage tank 150 is filled. In order to avoid possible damage to swab 140 if the operator does not raise the standpipe and boom assembly 14 all the way such that, as the truck backs away, swab 140 hangs up on the inside edges of the well head 138, the back-up plate assembly 126 is provided with an upper 128 and lower plate 130 hinged together at 132, and a sheer pin 134 to hold the plates in close approximation. When the swab 140 catches the well head 138, shear pin 134 will break, allowing lower plate 130 to break away from upper plate 128, thereby preventing damage to the apparatus (see Fig. 3*b*).

Although the invention has been described in terms of the foregoing preferred embodiment, this preferred embodiment is described by example only, and the scope of the invention is not restricted to this preferred embodiment. Rather, the scope of the present invention is limited only by the following claims.

What is claimed is:

1. An apparatus for removing fluid from a well comprising:

mobile support means;

a power winch mounted on said mobile support means having a cable attached thereto;

means operably connected to said power winch for maintaining relatively constant tension on said cable while said cable is wound off said power winch into a well;

a swab mounted on the free end of said cable for lifting fluid out of the well when said cable is wound back onto said power winch;

means in fluid connection with the well for receiving the fluid lifted out of the well by said swab.

2. The apparatus in claim 1 wherein said tension maintaining means comprises:

means for braking said power winch;

a brake control valve; and cable slack detection means for shifting said brake control valve from a first position to a second position, said second position being operable to apply said braking means to said power winch.

3. The apparatus of claim 2 wherein said cable slack detection means comprises a pulley riding on said cable, a control cable attached to said pulley, and a weight attached to said control cable.

4. The apparatus of claim 3 wherein said brake control valve is releasably clamped to said control cable.

5. The apparatus of claim 2 wherein said power winch braking means comprises a brake band which may be releasably applied to a drum which is integral with the reel of said power winch.

6. The apparatus of claim 5 wherein said power winch braking means additionally comprises a lever attached to said brake band at one end and having a weight suspended from the other end, and a hydraulic cylinder counteracting the downward force applied to said lever by said weight such that, when the hydraulic pressure to said cylinder is shut off, said weight causes said brake band to be applied to said brake drum.

7. The apparatus of claim 1 wherein said swab comprises a mandrel having a swab cup mounted thereon and a weight bar for causing said swab to sink down through the fluid in the well.

8. The apparatus of claim 7 wherein the mandrel of said swab is provided with an orifice through which fluid in the well passes as said swab moves downwardly in the well as said cable is wound off said power winch.

9. The apparatus of claim 8 wherein said orifice is provided with a valve for preventing the passage of fluid therethrough when said swab moves upwardly in the well as said cable is wound onto said winch.

10. The apparatus of claim 8 wherein said mandrel is provided with an insert and said orifice is located in said insert, said insert being releasably mounted on said mandrel.

11. An apparatus for removing oil from a well comprising:

mobile support means;

a reel mounted on said mobile support means;

a cable stored on said reel and having one end attached thereto;

a swab attached to the free end of said cable and having an integral weight for causing said swab to sink down through the oil in an oil well;

a motor for rotating said reel to lower and to retract said cable and said swab;

means connected to said reel and said cable for maintaining constant tension on said cable comprising a brake, a brake control valve, and cable slack detection means for shifting said brake control valve between a first and a second position, said brake control valve being operable in said first position to stop the rotation of said reel and to allow said motor to rotate said reel in said second position, allowing said cable to play out and down into the oil well; and means for receiving and storing the oil removed from the well when said cable is retracted by said reel.

12. An apparatus for maintaining relatively constant tension on a cable used to lower a weight through a fluid comprising:

a reel for storing a cable;

a cable attached to said reel;

a weight attached to the free end of said cable;

a drum integral with said reel;

a brake band encircling said drum and having a tension rod integral therewith, said tension rod being pivotally mounted to one end of a lever arm;

a first weight suspended from the other end of said lever arm;

means for overcoming the downward force applied to the end of said lever arm by said first weight, thereby preventing the application of force to said tension rod and the engagement of said drum by said brake band;

a pulley riding on said cable;

a second weight attached to said pulley operable to pull said pulley downwardly when said cable loses tension; and means for transmitting the downward movement of said pulley to said means for overcoming the downward force of said first weight operable to cause said means for overcoming the downward force of said first weight to cease overcoming the downward force of said first weight, thereby causing said brake band to engage said drum to stop the rotation of said reel.

13. A method of removing fluid from a well comprising:

lowering a swab on the end of a cable down into the fluid of said wells;

maintaining relatively constant tension on said cable by decreasing the rate at which said swab is lowered to compensate for the buoyancy of said swab once said swab reaches the fluid in said well;

effecting a seal between said swab and the walls of the well;

pulling said swab out of the well by retracting said cable; and collecting the fluid lifted out of said well by said swab.

14. The method of claim 13 wherein said swab is lowered through the fluid in said well by allowing the fluid to pass through an orifice in said swab.

15. The method of claim 14 further comprising closing said orifice when said cable is retracted.

16. The method of claim 14 wherein the rate at which said swab is lowered through the fluid in said well is changed by changing the diameter of the orifice in said swab.

17. A swab bar for use in removing fluid from a well comprising:

a mandrel;

means on said mandrel for retaining a swab cup around the circumference thereof;

means in said mandrel for allowing the passage of fluid therethrough as said mandrel is lowered down through the fluid in a well; and means in said fluid passing means for controlling the rate at which said mandrel is lowered through the fluid.

18. The swab bar of claim 17 wherein said fluid passing means comprises an orifice through said mandrel.

19. The swab bar of claim 18 wherein said mandrel is provided with an insert having said orifice located therein, said insert being releasably mounted in said mandrel whereby the rate at which said mandrel is lowered through the fluid is changed by mounting an insert in said mandrel with an orifice of different diameter.

20. The swab bar of claim 17 wherein said swab cup is retained on said mandrel by a flange on said mandrel.

21. The swab bar of claim 20 additionally comprises a weight wherein said mandrel threadably engages said weight and said swab cup is retained on said mandrel between said flange and said weight.

22. The swab bar of claim 17 wherein said swab cup is retained on said mandrel by a shear sleeve, said shear sleeve being releasably retained on said mandrel.

23. The swab bar of claim 22 wherein said shear sleeve is retained on said mandrel by frangible means.

* * * * *

UNITED STATES PATENT AND TRADEMARK OFFICE

CERTIFICATE OF CORRECTION

PATENT NO. : 4,751,969

DATED : June 21, 1988

INVENTOR(S) : Joseph H. Klaeger

It is certified that error appears in the above-identified patent and that said Letters Patent is hereby corrected as shown below:

Column 4, line 38, after "casing" add --176--

Signed and Sealed this

Seventh Day of February, 1989

*Attest:*

DONALD J. QUIGG

*Attesting Officer*

*Commissioner of Patents and Trademarks*